United States Patent [19]

Chen

[11] Patent Number: 4,962,926

[45] Date of Patent: Oct. 16, 1990

[54] SPHERICAL THROWING AND CATCHING DEVICE

[76] Inventor: Huei Mei Chen, No. 47, Lane 199, San Jiunn St., Shu Lin Town, Taipei Hsien, Taiwan

[21] Appl. No.: 462,567

[22] Filed: Jan. 9, 1990

[51] Int. Cl.[5] ..... A63B 43/02; A63B 37/14

[52] U.S. Cl. ..... 273/58 K; 446/490; 273/58 A; 273/428; 273/58 J

[58] Field of Search ..... 273/58 K, 58 B, 58 BA, 273/58 D, 58 E, 58 J, 65 EC, 428, 58 A; 446/490

[56] References Cited

U.S. PATENT DOCUMENTS

| | | | |
|---|---|---|---|
| 2,796,697 | 6/1957 | Beyrodt | 273/58 B |
| 3,231,925 | 2/1966 | Conder | 273/58 K |
| 3,633,587 | 1/1972 | Hunt | 273/58 K |
| 4,248,424 | 2/1981 | Judkins | 273/58 K |
| 4,756,529 | 7/1988 | Stillinger | 273/58 K |

*Primary Examiner*—George J. Marlo

*Attorney, Agent, or Firm*—Asian Pacific Int'l. Patent and Trademark Office

[57] ABSTRACT

A handy toy for throwing and catching, which includes a substantially spherical body comprised of a core holder and a big amount of unitary filaments which have each an elastic, circular rod-like structure and which uniformly radiate from the core holder; and a rust-proof steel ball inserted inside the core holder. The filaments and the core holder are unitarily made of elastic plastic material through injection molding process to form a soft and elastic spherical body for amusement.

1 Claim, 2 Drawing Sheets

SPHERICAL THROWING AND CATCHING DEVICE

BACKGROUND OF THE INVENTION

The present invention relates to a handy toy, and more particularly, to the one which has a substantially spherical configuration made through injection molding process, and which is formed from a big amount of floppy, slender filaments that uniformly radiate from a central core.

U.S. Pat. No. 4,756,529 to Stillinger, disclosed an amusement device which has a substantially spherical configuration, and which is formed from a large plurality of floppy, elastomeric filaments that radiate in a dense, bushy manner from a central core region. This amusement device is easy to throw and catch for amusement. According to Stillinger's disclosure, three long lengths of extruded rubber filaments are each wound in a pattern of reverse bend loops, the three stretched loop units are then placed relative to one another along thee orthogonal axis, and a conventional cinching device is wound where the wound filament loops centrally cross one another and drawn tight to gather them. One of the disadvantages with the Stillinger's amusement device is that the winding process makes the manufacturing process complicated and time consuming. Another disadvantage of the said amusement device is that the filaments can not be uniformly wound to the central core region, i.e. some may densely gathered to the central core region and some others may loosely gathered thereto. As a consequence, an attractive outer appearance can not be achieved. This disadvantage of poor outer appearance will become more apparent a certain period after use.

SUMMARY OF THE INVENTION

The main object of the present invention is to provide a handy toy for throwing and catching, which is generally made of elastic plastic material through injection molding process, and in which a big amount of unitary, floppy, elastic filaments are uniformly secured to a core holder to form therewith an attractive hedgehog-like body which does not deform easily.

Another object of the present invention is to provide a handy toy for throwing and catching, in which there is a core holder having a hole in a diameter of 2 mm which can be stretched to open for the insertion therein of a steel ball so that the toy will sink when it is placed in water, and in which the spherical body is formed of a big amount of floppy, slender, circular rod-like filaments uniformly radiate from a core holder which do not hurt during throwing/catching amusement game play.

According to a preferred embodiment of the present invention, the handy toy takes the form of a plurality of floppy, circular rod-like filaments incorporated with a core holder in such a manner that they radiate uniformly outwardly from the core holder to form therewith a substantially spherical object. The filaments and the core holder are unitarily made of elastic plastic material through injection molding process so as to satisfactorily avoid the disadvantages encountered in the aforesaid amusement device which apply binding process to secure filaments to a core region.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENTS

Figure 1:
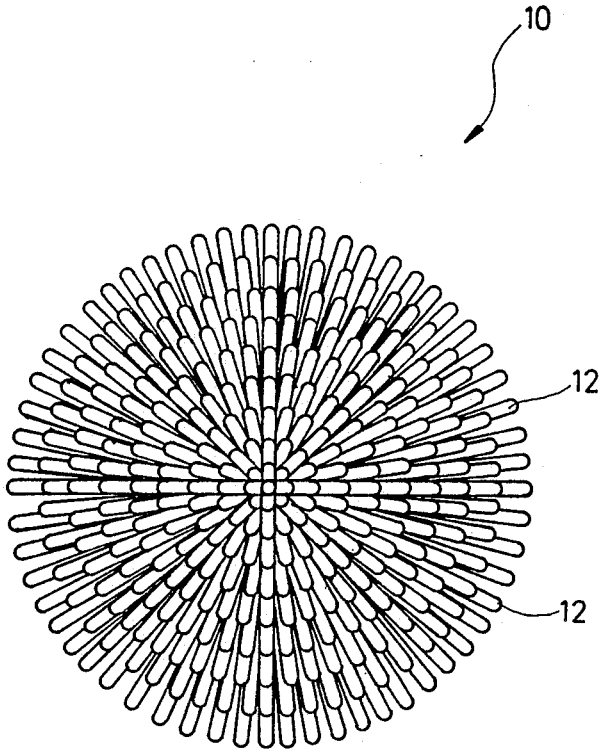
FIG. 1 is a perspective view, illustrating the outer appearance of a handy toy embodying the present invention.
Figure 2:
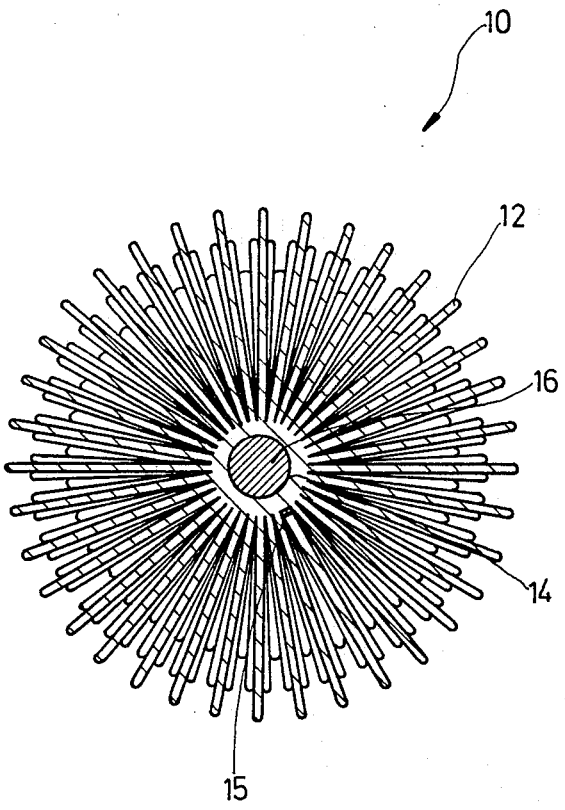
FIG. 2 is a sectional elevation of the handy toy of FIG. 1.

Referring to FIGS. 1 and 2, a handy toy of the present invention is a throwing/catching device which is easy to catch and has substantially spherical body (10). The spherical body (10) comprises a steel ball (16) covered with a core holder (14) and a big amount of floppy, elastic, slender filaments (12). The filaments (12) and the core holder (14) are unitarily made of plastic material through injection molding process.

The steel ball (16) is made of lead or nickel-chrome alloy which is rust-proof and provides high specific gravity and density. Because the specific gravity of the steel ball (16) is much higher than water, the steel ball (16) immediately carries the connected core holder (14) as well as the filaments (12) to sink, like a hedgehog, when the spherical body (10) is placed in water. Because the high density steel ball (16) is positioned in the core of the spherical body (10), the spherical body (10) can be more stably and accurately played in throwing and catching.

The filaments (12) are made of a kind of plastic material commercially named KRATON-G from American Shell. During production, a solvent is added to the material of KRATON-G for softening. After the injection molding process, a big amount of floppy, slender, elastic filaments (12) uniformly radiate from a core and form a spherical body (10) like a lively hedgehog. The filaments (12) each have an elastic, soft, fine, circular rod-like structure convenient for hand grasping. The elastic, soft, fine, circular rod-like structure provides good shock absorbing effect. At the instant the spherical body (10) is caught, the filaments (12) absorb much energy and, unlike the convenient similar throwing-/catching devices, do no bounce or get away from one's grasp easily. Because the filaments and the core holder are shape molded into a consolidated unit, the filaments do not break or deform easily and are constantly maintained in right position uniformly radiating from the core holder.

The core holder (14), described as above, is made of KRATON-G added with a solvent for softening so as to provide suitable elasticity property after made with the filaments (12) through injection molding process. The core holder (14) is disposed in the central part of the spherical body (10) and the filaments (14) unitarily radially extend outward therefrom. The core holder (14) has a hollow body comprising a hole (15) in diameter about 2 mm through which the steel ball (16) can be inserted inside the core holder (14). Because of the high elasticity of its material property, the hole (15) can be stretched open to a diameter of 20 mm or more so that the steel ball (16) can be conveniently placed inside the core holder (14). After stretching force is released from the core holder (14), it draws together immediately to turn the hole (15) to original size. The connecting area between the core holder (14) and the filaments (12) defines to the cross sections of the filaments (12) so that a fine and attractive outer appearance can be obtained. Because of the high elasticity of the material property of the KRATON-G, the filaments (12) do not break or deform during throwing and catching operation.

Having described my invention as related to the embodiment shown in the accompanying drawings, it is my intention that the invention be not limited by any of the details of description, unless otherwise specified, but rather be construed broadly within its spirit and scope as set out in the appended claim.

What is claimed is:

1. A handy toy having a substantially spherical, hollow body including a hollow, highly elastic core holder having a hole therein which can be stretched open for the insertion therein of a steel ball and can automatically contract to return to original size after the stretching force is released therefrom, said core holder comprising a large number of unitary, fine, floppy, elastic, circular rod-like filaments which uniformly radiate from said core holder to form therewith a hedgehog-like spherical body.

* * * * *